United States Patent [19]

Remedio et al.

[11] Patent Number: 4,910,677

[45] Date of Patent: Mar. 20, 1990

[54] GOLF SCORE RECORDING SYSTEM AND NETWORK

[75] Inventors: Joseph W. Remedio, 555 S. Ocean Blvd., Boca Raton, Fla. 33432; Michael R. Appleton, Lauderdale Lakes, Fla.

[73] Assignee: Joseph W. Remedio, Boca Raton, Fla.

[21] Appl. No.: 195,659

[22] Filed: May 18, 1988

[51] Int. Cl.[4] ..... G06F 15/44

[52] U.S. Cl. ..... 364/410; 273/32 R

[58] Field of Search ..... 364/410, 411, 412; 340/323 R; 273/32 R, 32 H, 162 A, 1 E, 85 G

[56] References Cited

U.S. PATENT DOCUMENTS

| | | | |
|---|---|---|---|
| 3,665,494 | 5/1972 | Baumoel | 364/410 |
| 4,142,236 | 2/1979 | Martz et al. | 364/411 |
| 4,192,510 | 3/1980 | Miller | 273/176 A |
| 4,266,214 | 5/1981 | Peters, Jr. | 340/323 R |
| 4,268,744 | 5/1981 | McGeary | 235/375 |
| 4,283,056 | 8/1981 | Miller | 273/176 A |
| 4,319,131 | 3/1982 | McGeary et al. | 235/375 |
| 4,367,526 | 1/1983 | McGeary et al. | 364/411 |
| 4,648,066 | 3/1987 | Pitt | 364/900 |
| 4,815,020 | 3/1989 | Cormier | 364/709.11 |

FOREIGN PATENT DOCUMENTS

| | | |
|---|---|---|
| 0022173 | 7/1985 | Japan . |
| 0067169 | 4/1986 | Japan . |

OTHER PUBLICATIONS

Forbes, "Epson Computer Network Maintains Golf Scores, Stats, Data at PGA Meets", *Computer Technology Review*, vol. 7, No. 10, Aug. 1987, pp. 4–8.

*Primary Examiner*—Clark A. Jablon
*Assistant Examiner*—David M. Huntley
*Attorney, Agent, or Firm*—Kenneth E. Merklen

[57] ABSTRACT

A computer network for use in the game of golf includes a central computer communicatively connected to a plurality of local master computers. Each local master computer transfers and receives golf related information to and from a plurality of mobile modules carried along by the golfer on the golf course. Transfer of information between the mobile modules and the local master computer is by ROM and RAM cartridges. The mobile modules present a display of the golf course played on, and allow for input of scoring data by the players.

14 Claims, 18 Drawing Sheets

CENTRAL COMPUTER MODULE

GOLF SCORE RECORDING SYSTEM AND NETWORK

BACKGROUND OF THE INVENTION

The present invention relates to data or information generation, storage and retrieval systems and apparatus used therefor. In particular the present invention is a data or information generation, storage and retrieval system and/or network particularly useful in providing golf players with golf information; generating raw golf scoring data in accordance with input from golf players; generating adjusted golf scoring data peculiar to a golf player in accordance with the player's profile and other course factors peculiar to the course played.

The nature of the game of golf, that is, the manner in which the game is played and the score processing system are closely interrelated. The game or scoring profile depends upon the type of game played. Games such as callaway, skins, calcutta and straight golf, for example each identify a particular method of playing golf and a manner of scoring. When a party of golf players decide what type of golf game they intend to play, the method of scoring the game can be determined.

Once the manner in determining the raw golf data or actual strokes score is determined the raw golf data is adjusted in accordance with the player's profile and course factors such as course rating and slope rating. This adjusted score may then be compared with the course "par", that is, the number of strokes a player should take to "hole" the ball from the tee. The value of "par" is set forth on a hole-by-hole basis and referred to as "par for the hole" and by the course basis, referred to as "par for the course".

The player's profile is the name or other identification of the player and his handicap. Handicap is a score advantage calculated by using the best ten (10) raw strokes score out of the last twenty (20) golf games played by the player.

The course rating is a value given to the golf course based on the distance of the holes, that is the distance between the tee and cup or hole for all eighteen (18) holes, compared with other golf courses. The slope rating is the difficulty of the golf course compared with a norm.

The various formulas for each of these variables are established by the United States Golf Association (USGA) and are published in a copyrighted publication one example of which is; "USGA Handicap System, Effective Jan. 1, 1987", copyrighted 1986 by United States Golf Association.

From the above it becomes apparant, that playing a game of golf involves much more than selecting a golf club and hitting a golf ball with the selected club with an objective of putting the ball in a cup. A highly complex score keeping system is involved. Further, this highly complex score keeping system is further complicated when the same player plays different golf courses, each of which has its own course variables.

PRESENT INVENTION

The present invention is a network or system of golf data generation, storage and retrieval apparatus set forth in a multi-level network, including a central master golf data storage and retrieval computer module, a plurality of local master golf data storage and retrieval computer modules and a plurality of mobile or slave computer modules.

Preferably the table of organization of the network or system provides for a central master data storage and retrieval computer module which communicates with a plurality of local master golf data storage and retrieval computer modules, each local master module being unique to a particular golf course and storing therein data relative to the course profile of its own or associated golf course, the course rating and slope rating of its own golf course and player profiles of player club members or of guest players entered into the memory bank of the local master computer module. Each local master computer module is connected to the central master computer module and data is transmitted. between them. One golf club may have only one golf course while other golf clubs may have several golf courses. In the case of a single golf course golf club only one functioning local master computer module would be used, in the case of a golf club that has two or more golf courses, the golf club would have one functioning local master computer module for each respective golf course. Thus, with each local master computer module connected to the central master computer module, the central master has access to golf data from a plurality of sources.

Each local master computer module has associated therewith a plurality of mobile data generating storage and retrieval computer modules, each of which is provided with a transferable memory programmed with the course profile of the golf course on which the mobile module is used. The mobile computer module includes a terminal or key pad used for interrogating the module and for inputting data into the module. In addition, the mobile module includes a display on which the course profile of the golf course may be displayed. The course profile, that is, the physical characteristics of the golf course, may include the overall physical layout of the golf course as well as the physical layout of the various holes and fareways, in varying degree of detail. The course profile is preferably programmed into a transferable ROM and may include details such as yardage, fareway and green conditions, obstacles, hazards and other data that may be helpful to a golf player. The ROM may also include game profiles of games that may be played on the golf course. Selection of the type of golf game to be played may be made by the players during pre-game processing. The slope rating of the course may also be included.

The ROM, which is transferable between the local master and the mobile module may be pre-programmed with the golf course profile since the physical characteristics of a golf course change very little day-to-day. The course profile data may be checked and updated periodically, if desired. In addition, the game profiles, that is, the rules and/or conditions of play of particular games of golf also have stability and may be pre-programmed in the ROM.

Thus, according to the computer program used, the transferable ROM may be pre-programmed and periodically updated with course profile data and game profile data, to maintain accuracy or the roving ROM may be processed in the pre-game processing and programmed with the golf course profile on which the golf game is to be played and programmed with the game profile of the game to be played, all during pre-game processing.

If desired, gaming or betting may be included and programmed in the ROM.

The local master computer module preferably provides for, programming a RAM or non-volatile memory with player profile data and, in some cases, the type of game selected to be played. The selection of the game to be played may be programmed in the RAM and the rules of the game selected may be taken from the ROM.

When two different memory devices are used both memory devices would be in transferable form and effectively programmed by the local master and transferred to the mobile module. The RAM or non-volatile memory receives input data from the players during the game while the RAM is connected to the mobile module. At the end of the game both the ROM and the RAM are return transferred to the local master so that the RAM may be debriefed and the ROM may be updated, if necessary.

The mobile module preferably includes an interface adapted to accept the RAM or non-volatile memory, the RAM having been programmed with player data by the local master computer module. The player data or player profile may include identification of the player or players, preferably in the order of play, and the handicap of each player.

The mobile module preferable includes the capability to make mathmatical calculations so that the stroke scores of the players or players may be remembered, accumulated and adjusted, according to the player's handicap and/or any other score variables. A display, such as a CRT, for example, or other visual display is also provided in the mobile computer module so that both the raw stroke score of the player and the adjusted stroke score of the player may be displayed. The visual display in the mobile module is also used to display the course profile on at least a hole-by-hole basis with visual display of the hole characteristics and other data pertaining to the hole displayed. In addition, beam spotting is provided so that a player may virtually spot the position of the lie of his ball on the fareway display, with the mobile computer module including the capability of computing the distance from the beam spot to the pin and providing a display of such distance.

A terminal or key pad or keyboard is provided so that the stroke scores may be entered into the mobile computer and the mobile computer module may be interrogated relative to course data, player data or betting, if betting or gaming factors have been programmed into the transferable memory.

The scores entered into the mobile computer module are placed in the RAM and, when the RAM is removed from the mobile module and inserted into the local master computer module the scores in the RAM are read and placed in the memory of the local master computer module, addressed to the player who made the score.

From one aspect, the present invention provides a virtually automated score keeping system. Although it is possible to count the strokes taken or made by a player through electronic or automated means, it is, at present, cost prohibitive to equip a golf course with the hardware to detect each stroke. It is, at present, more practical, from a cost standpoint, to provide a means of entering the stroke count through a non-automated means, such as by operation of a key board, for example. Another way of entering the stroke count of the player would be by audio means, that is, either voice actuated or other sound actuated input into the mobile computer module. However, the more personal and more secure method of entering stroke scores during a golf game is by key board entry, which is the preferred method. Another acceptable entry method would be a card entry system. In the card entry system the player would mark the stroke score on a card and insert the card into a receiving interface in the mobile module. The data entered on card can be read by the mobile computer module and entered into the RAM of the mobile module.

The mobile computer module may be mounted on a golf cart, for example and may be driven from the battery source which is used to drive the golf cart. The components of the mobile computer module including, without limitation, the display, the key board and the CPU and various memory components may be mounted on the golf cart at convenient locations. It is anticipated that the key board may be a remote key board which communicates with the mobile computer module via an air link. Such a remote key board or key pad may be carried by the player and the player's score could be entered into the mobile computer module without the need for the player returning to the golf cart. The key board or key pad is, however, preferably mounted on the golf cart or on the computer module itself and hard wired to the module. This preferred structure avoids the need for an independent power supply, as would be required for a remote key board or key pad. Further, the use of a remote key input would almost require that the player carry the remote key pad input device.

It is also anticipated that the mobile computer module may include a battery pack and that the mobile module be coupled to a golf bag.

From another aspect the present invention provides a personalized score calculating system with both display on demand and memory so that the score data, both raw and processed may be entered into the golf club record, retained by the local master computer module. Further, there is available to the player a display of the over all golf course on which he is playing and a display of the particular hole he is playing or about to play, in the program flow or on demand. The mobile computer module may also include electronic beam steering whereby an electronic beam or spot may be located, both vertically and horizontally on the face of the display. This may be used in conjunction with the display on the CRT, for example, of a fareway whereby, by using the beam steering capability, a player may locate the proximate position of his ball on the fareway and have this virtual position displayed on the CRT.

From a still further aspect the present invention provides a computerized golf record keeping system of the players on a golf course, at the golf club level and a golf record keeping system of the players at a plurality of golf clubs. The golf record keeping network may be set up on a regional basis, that is, all the golf clubs or golf courses having computerized golf record keeping systems in an established region may be connected to the same regional central computer module. The regional central computer modules, of which there may be several, may be connected to a national central computer module.

It is acknowledged that the apparatus used to structure the mobile computer module, the local master computer module and the central computer module may be off the shelf components and may be assembled using present technology. However, prior to this invention there was no system or network such as proposed and disclosed herein.

DETAILED DESCRIPTION OF THE INVENTION

Figure 1:
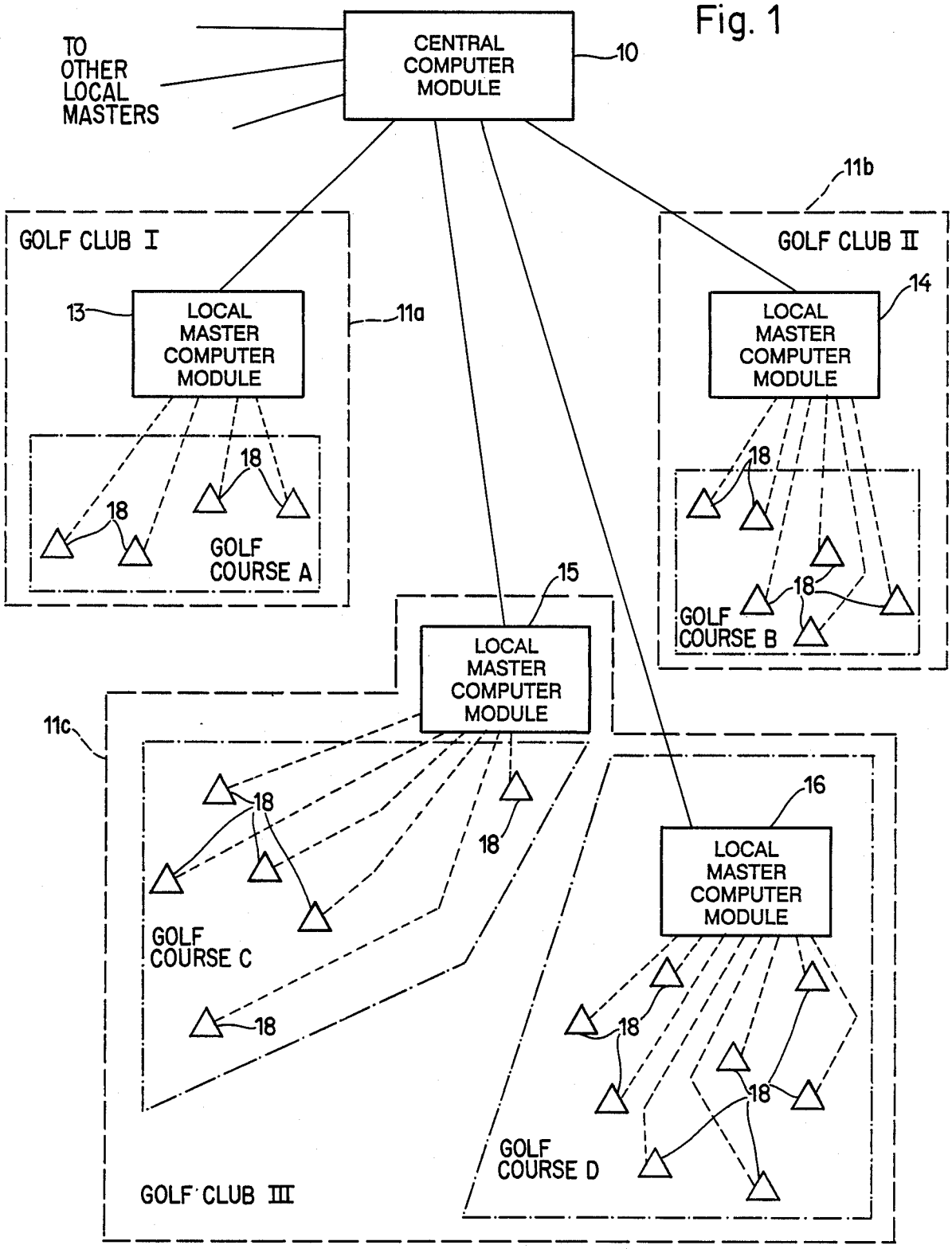
FIG. 1 is a block diagram of a golf score recording network.

Referring to FIG. 1, a multi-level golf data calculating and recording system of network is represented in block form.

At the head of the system or network is a central master computer module 10 which is in communication with each of a plurality of local master computer modules, each local master computer module being associated with a particular golf club. The elongated broken line boxes 11*a*, 11*b* and 11*c* each represent a golf club, golf club I golf club II and golf club III respectively. Each golf club has at least one golf course. As represented golf club I includes golf course A, golf club II includes golf course B while golf club III includes golf courses C and D. While each local master computer module 13, 14, 15, and 16 is associated with a particular golf club each respective local master computer is identified with a particular golf course. Local master computer module 13 is associated with golf club I but is identified with golf course A; local master computer module 14 is associated with golf club II but is identified with golf course B; local master computer module 15 is associated with golf club III but is identified with golf course C; and local master computer module 16 is associated with golf club III but is identified with golf course D. Each golf course is represented by elongated and shorten broken lines.

Each local master computer module has associated there with and working therefore a plurality of slave or mobile computer modules. The mobile computer modules are represented by small triangles, 18 and each is connected to the local master with which the mobile module is associated by a broken (shortened) lines.

The location of the central computer module is not critical. Preferably it should be located at some central point equally convenient to the local master computer modules in the network of which the central module is a part.

As will be later discussed, the block diagram of FIG. 1 may represent a regional network and a plurality of regional networks may be cascaded into a national network, which could be further cascaded into a world wide network of a golf score recording and golf data distribution system.

Figure 2:
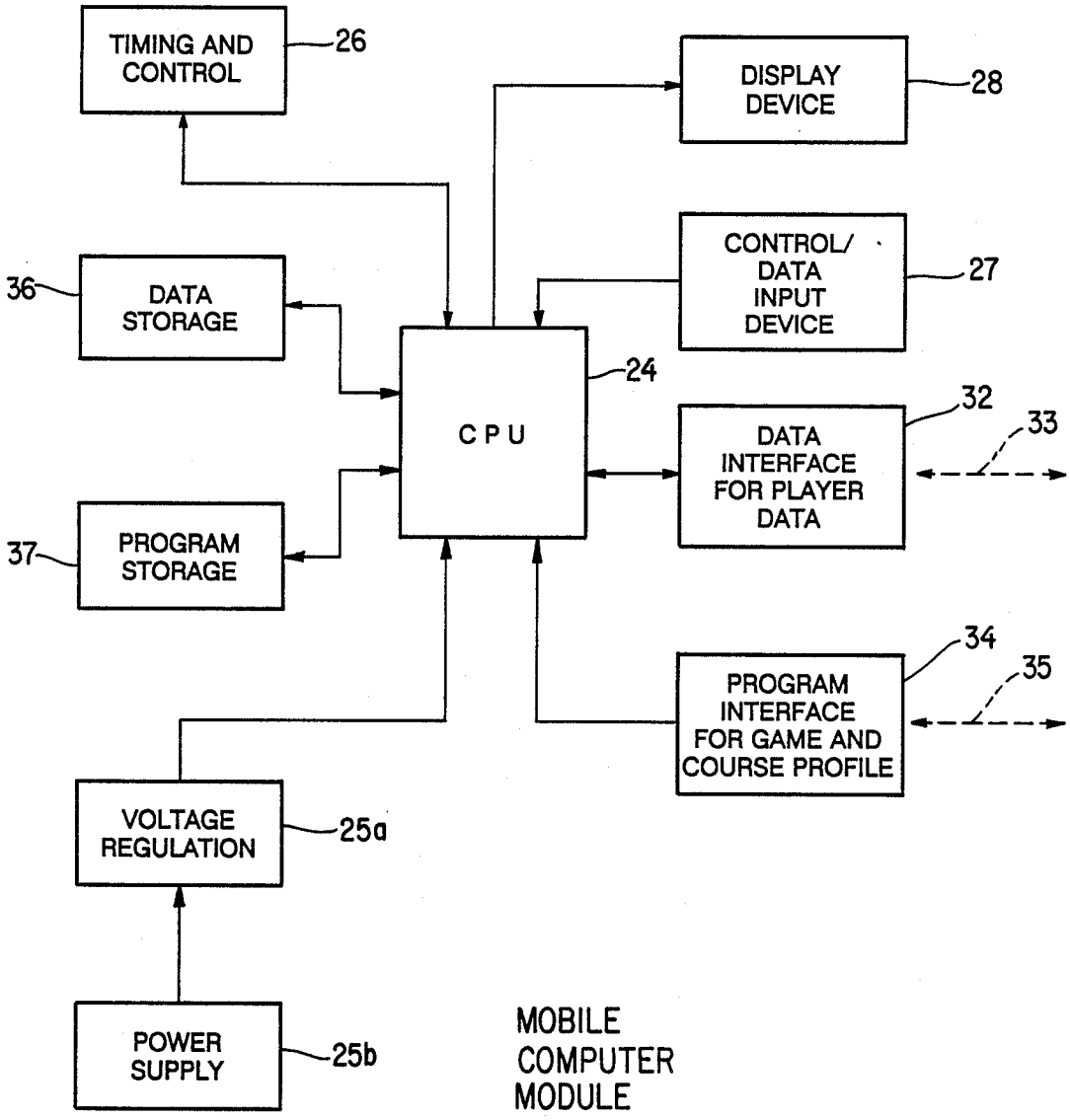
FIG. 2 is a block diagram of a mobile computer module, a component in the golf score recording network.
Figure 2A:
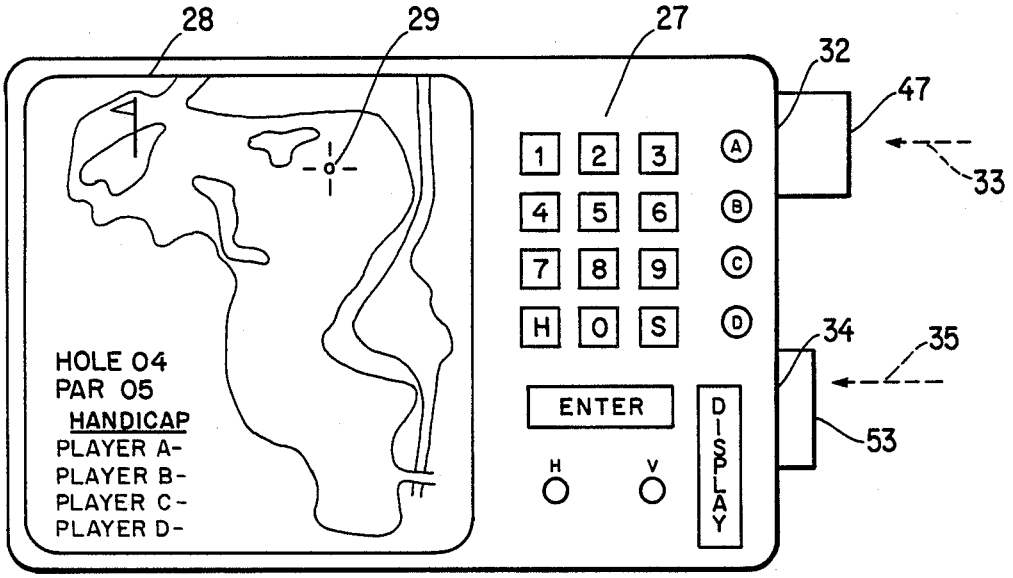
FIG. 2*a* is a representation of a front panel, with display, of a mobile computer module.
Figure 2B:
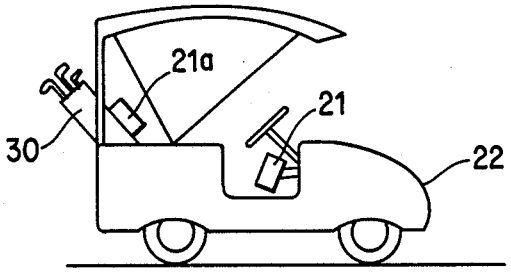
FIG. 2*b* is a representation of a mobile computer module mounted on a golf cart.

Referring now to FIG. 2 a block diagram of the structure or hardware of a mobile or slave computer module is provided. This block diagram merely represents a mobile module. Preferably the mobile computer module is small and compact so as to accord portability. In some cases, such as represented in FIG. 2*b* the mobile module 21 may be mounted on a golf cart 22. Since a golf cart is usually electric motor propelled, the mobile module may be connected to the battery used to drive the electric motor (not shown) of the golf cart 22. In an alternate construction the compact mobile computer module may include its own power pack, affording total portability so that the mobile module and its power pack can be stored in and carried in a golf club bag, or on a hand propelled cart where electric golf carts are not available.

As represented in FIG. 2 the mobile module includes a CPU (Central Processing Unit) 24 driven by a regulated voltage/power supply 25*a*/25*b*. A timing and control component 26 controls the cyclic operation of the CPU and maintains synchronism. The control/data input device 27 may be a terminal or key pad or key board such a represented at 27 in FIG. 2*a*, by way of an example, for entering commands and/or golf data. The display device may be a CRT or other visual display capable of displaying data and/or graphics such as represented in FIG. 2*a* at 28. The display represented on the face of the display device includes a graphic representation of a golf course hole, identified as HOLE 04. The data includes the PAR stroke value or number of the hole and the handicap of each player. Also represented is a spot beam 29 which is positioned by using the buttons H and V for horizontal and vertical beam drive button. By using the bottons H and V a player may simulate the lie of his ball on the fareway and the computer, which has the capability of calculating the distance between the spot beam on the fareway and the pin can indicate the distance the ball must travel to reach the pin. This feature is programmed into the computations functions of the mobile computer module.

The golf data entered by way of the key pad 27 may be the raw stroke score of the players for the hole. The players are each represented by a button A B C, and D. A hole or fareway may be displayed on command by pressing the key H and the number of the hole desired to be displayed. The bar key DISPLAY is then pushed to complete the command.

To enter a score on the hole displayed the key S is pushed followed by the stroke score, then the bar key ENTER is pushed. If the score is for a particular player the button A, B, C or D would be pushed, the button corresponding to the player's identification, prior to actuating the ENTER key.

As previously stated the mobile module may include its own power pack and be completely portable. Such an alternate structure is represented at 21*a*, attached to the golf bag 30.

Returning to FIG. 2, the mobile computer module further includes a data interface 32 and a program interface 34. The data interface 32 is adapted to receive a transferable RAM, programmed by the local master computer module, represented in block form in FIG. 3. The program interface 34, of the mobile module is adapted to receive a transferable ROM, programmed or updated by the local master computer module The data interface transfers player data or player profiles from the transfer RAM to the data storage 36 while the program interface transfers game profiles and course profile data from the transferable ROM to the program storage 37.

The broken line 33 represents that the RAM 32, which is preferably a non-volatile memory, is transferable between the local master and the mobile module and the broken line 35 represents that the ROM, 34, is transferable between the local master and the mobile module.

Figure 3:
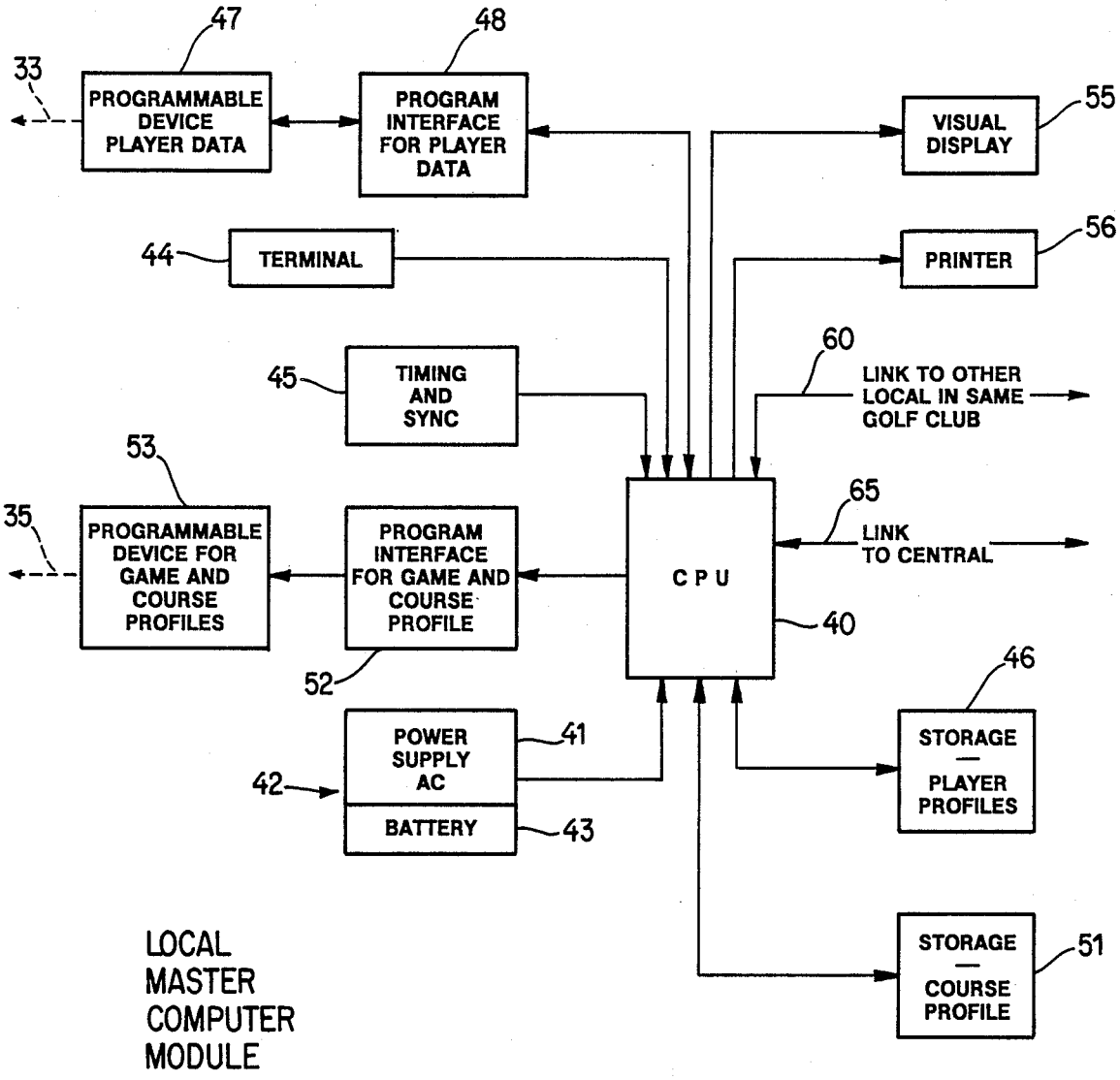
FIG. 3 is a block diagram of a local master computer module, another component in the golf score recording network.

Referring to FIG. 3, the local master computer module is represented in block form. The local master computer module or local master is associated with a particular golf club and is identified with a particular golf course. In some cases a golf club has one golf course. If this be the case, the golf club will have one functioning local master. In other cases a golf club may have two or more golf courses, each playable through the golf club by members and/or guests of the member or the club. If a golf club has, for example three (3) golf courses, the golf club will have three (3) functioning local masters, each master being identified with one of the golf courses, respectively of the golf club.

Each local master is adapted to store player profiles and it is preferred that the player profiles stored in the local master are profiles of golf players who play on the golf course with which the local master is identified. In effect, the local master keeps a record of the golf games played on the course with which it is identified. In addition, the local master stores the course profile of the golf course with which the particular local master is identified. Also, games playable on the golf course, with which the local master is identified are also stored in the memory of the local master computer module.

The local master includes a CPU 40 and a power supply 42. The power supply 42 includes the AC power supply or house power 41 which is rectified into a usable DC supply for normally driving the computer A battery supply 43 is also provided which functions as a back-up supply insuring that the data stored in the memory of the computer will not be lost due to AC power failure.

A terminal 44, which is preferrably in the form of a key board, is provided to input both commands and data. The cycles operation of the computer is maintained by the timing and sync control 45.

The memory or storage 46 stores player profile data which data is retrievable for programming the progrommable, transferable device 47. The programmable device 47 is plugged into the program interface 48 through which the programmable device is programmed. After the programmable device 47, which may be any type of programmable, transferable device, is programmed, the device 47 is removed from the local master and plugged into the mobile computer module which is used by the players whose player profiles have been programmed into the device.

In the event one of the golf players in the group or foursome is not a club member and/or has not played on the golf course with which the particular local master is identified then the local master may get his player profile from another course. If the player is a member of the golf club but has only played golf on another golf course associated with the golf club, then the particular local master can quiry the local master identified with the other golf course for the player's golf player profile. If, on the other hand the player has not played on any golf course associated with the particular golf club but has played golf on another course of a club in the network of clubs as the club which includes the golf course on which the player wants to play golf, then, the particular local master may quiry the central master computer and obtain the player's golf player profile.

Thus, so long as a golf player has played golf on a golf course in the network or system and the golf player's golf record is recorded and/or stored in the central computer module or in a local master on the same golf club, then the player profile of the player may be retrieved and programmed into the programmable, transferable device for use in the mobile computer module.

The memory or storage 51 is provided to store the course profile of the golf course with which the particular local master computer module is identified. In addition the storage 51 may be used to store game profiles of games playable on the golf course with which the particular local master is identified.

The data stored in the memory 51 may be retrieved and duplicated in the program interface 52 and then may be used to program the programmable, transferable device 53. Like the programmable, transferable device 47, the device 53 may be any type of programmable, transferable device. The type of programmable, transferable device must of course be compatable with the mobile computer module and insertable into the mobile module.

The local master also includes a visual display, 55, which may be a CRT and a printer 56, which can be used to print out hard copies of the data displayed on the display device or of input data or output data.

The local master includes links 60 and 65, link 60 links or connects the particular local master with other local master computer modules of the same golf club, that are identified with other golf courses in the same golf club. Through link 60 the local masters of the same golf club can communicate with each other.

The link 65 provides a link to the central computer module of the network of which the local master computer module is a part. The links 60 and/or 65 may be a hard wire or air link.

It will be appreciated that course profile data, when duplicated in the programmable device 53, translates into a graphic display of the golf course with which the particular local master is identified, when the programmed programmable device is removed from the particular local master and inserted into a mobile computer module the graphic display of the over all golf course and a hole-by-hole display is displayed on the visual display of the mobile module. Other course profile data includes the par for each hole and the distance from the tee to the pin. Remarks relating to each hole may also be provided along with a display of the hole, such as represented in FIG. 2*a*.

Figure 4:
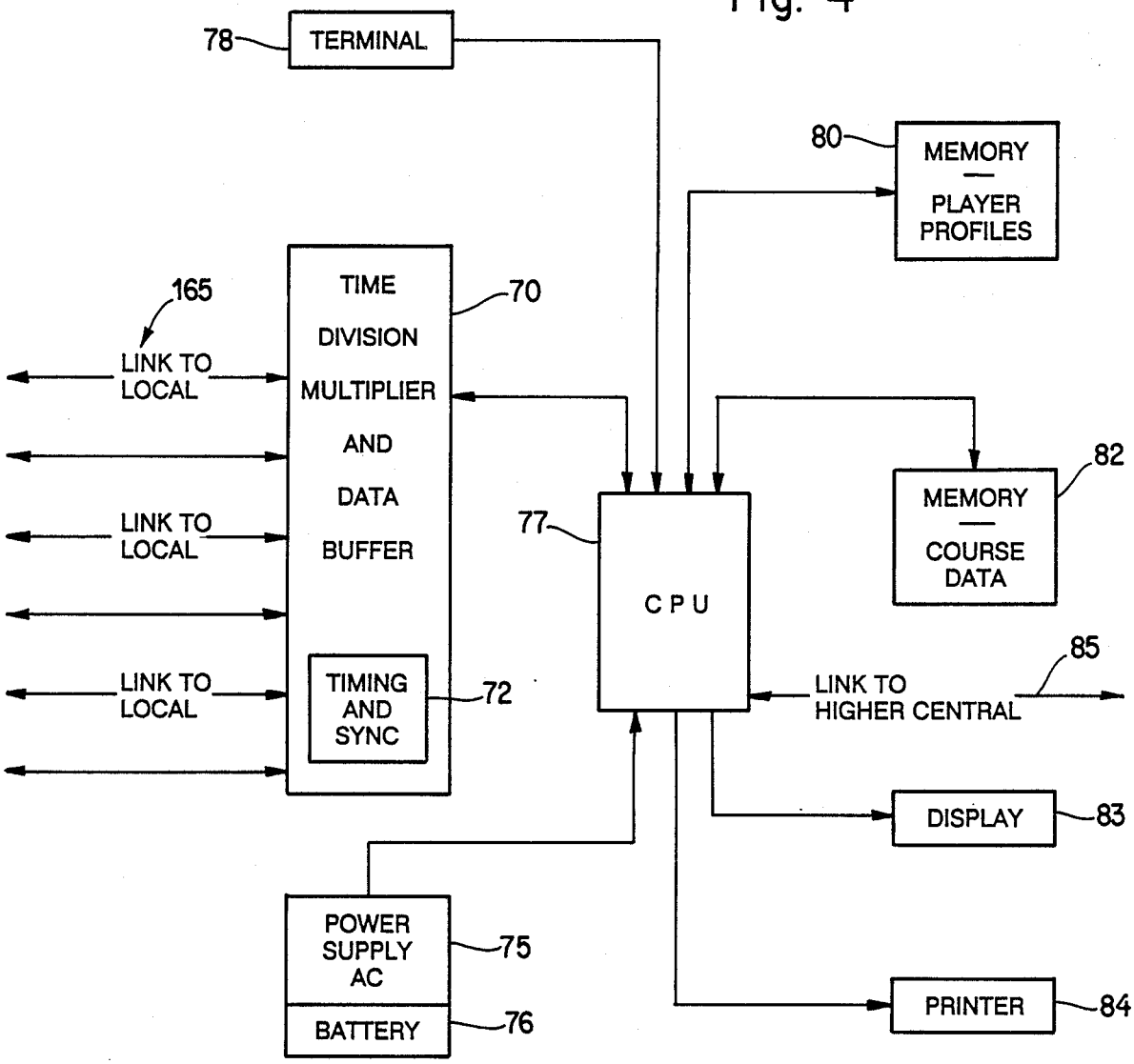
FIG. 4 is a block diagram of a central computer module, another component in the golf score recording network.

Referring to FIG. 4, a representation of a central computer module, usable in the network or system is presented, in block diagram form. The central module is linked to the local master computer modules so that commands and data may be transfered betweem them.

The central module is used basically to store player profiles and course profiles or data received from the local master computer modules in the network and to provide player profile data and/or course profile data to a local master in the system, upon request.

The communication links between the local master computer modules and the central computer module are represented as a plurality of lines 165 which feed into the time division multiplier and data buffer 70 Included in block 70, for convenience is block 72 which represents a timing and sync control. An AC power supply 75 is rectified into a DC of a magnitude usable by the computer components. A battery power supply 76 provides back-up power to prevent loss of memory in the event of a power failure of the main power supply 75.

The CPU or central processing unit 77 may be programmed to work on time sharing because of the relatively large number of local master computer modules tied into the same central module. A terminal 78 is provided for entering commands and other data, however player profiles and course data are provided, for the most part as input from the various local master modules in the network.

The memory 80 is used to store player profiles, while the memory 82 is used to store course data. This data is received from the various local master computer modules of the system and may be retrieved by any local master module in the system.

A display 83 such as a CRT, for example is provided for visual display of data and a printer 84 is provided for providing hard copies of data.

The concept of the invention provides for a golf score or record keeping system that is multi-level and may have more levels than represented in the block diagram of FIG. 1. FIG. 4 includes a link to a higher central computer module 85. The multi-level system may be cascaded into a plurality of regional networks with the regional networks each in communication with a national central computer module. Several national central computers could be combined into a higher network where the national modules communicate with a worldwide computer module.

It will be apparent to those skilled in the art that the various computer modules will be controlled by a program. The programs written and sequence of the cyclic steps are a matter of choice. However, sets of flow charts are provided for the mobile computer module and for the local master computer module. The flow charts are examples of flow charts that may be used in the system since, as with the program sequence, the sequence of the flow chart is a matter of choice.

FIGS. 5 through 11 inclusive are examples of flow charts that may be used to guide development of a program for a mobile computer module. FIGS. 12 through 16 inclusive are examples of flow charts that may be used to guide development of a program for a local master computer module. It will be apparent that all the local master computer modules in the same network or system need not have the same program written into the computer. It is preferred that all the computer functions be included, such as these provided in the examples of the flow charts, however, some variables may be omitted or may be changed. One example of a variable that may be changed from one local master at one golf club to another local master at another golf club are the gaming or betting variables. Game play variables may also vary between golf courses. Thus, the flow charts are examples of a set of flow charts that may be used.

Figure 5:
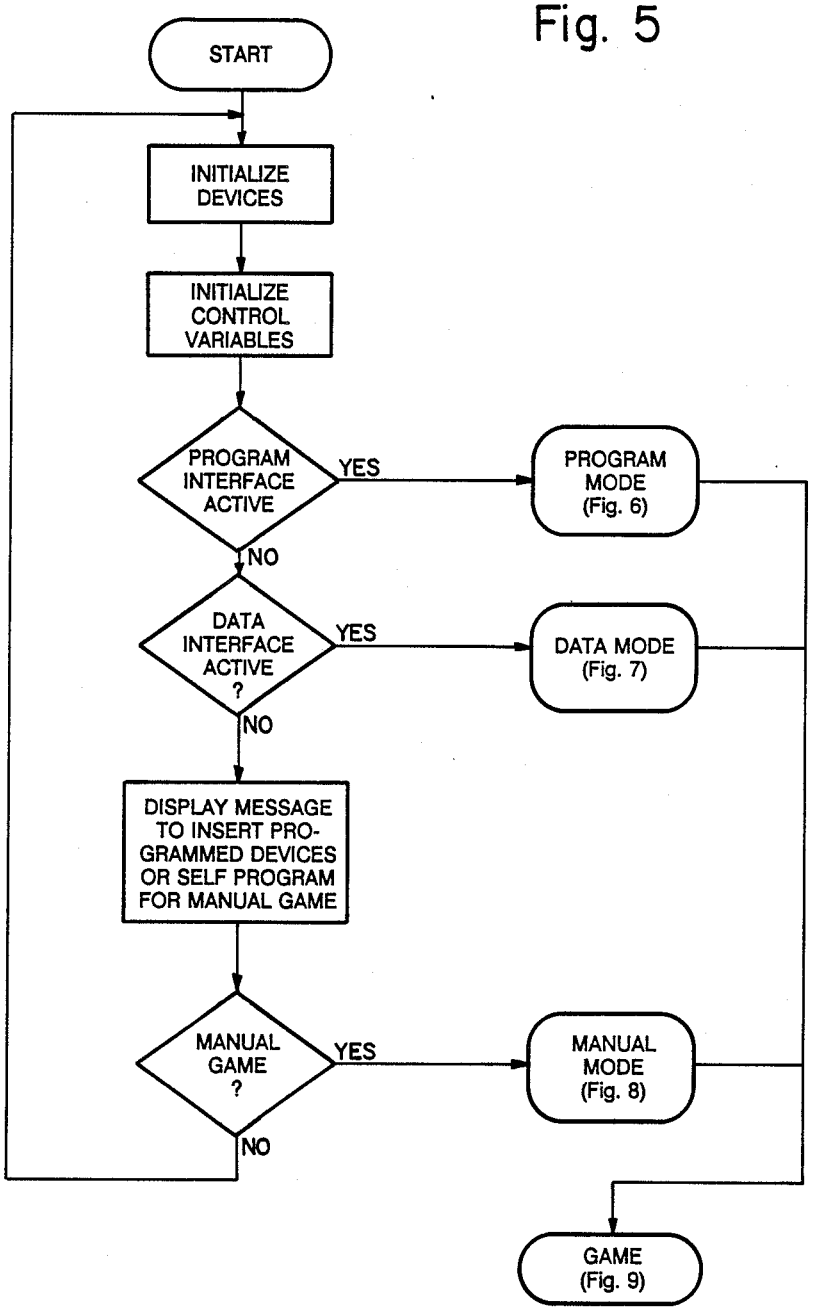
FIG. 5 is a representation of a basic flow chart for a mobile computer module usable in a golf score recording system and network.
Figure 6:
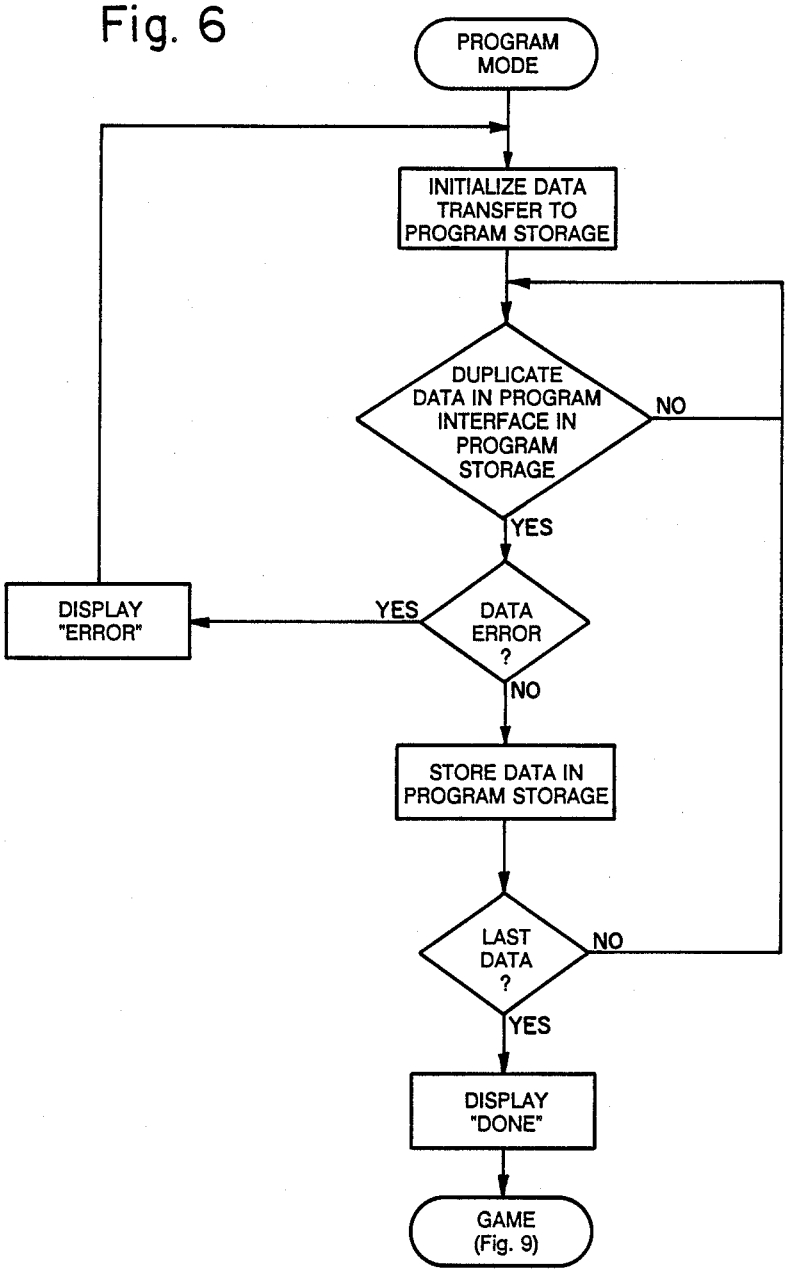
FIGS. 6 through 11 inclusive are flow charts of the various processing required in the basic flow chart for the mobile module.
Figure 7:
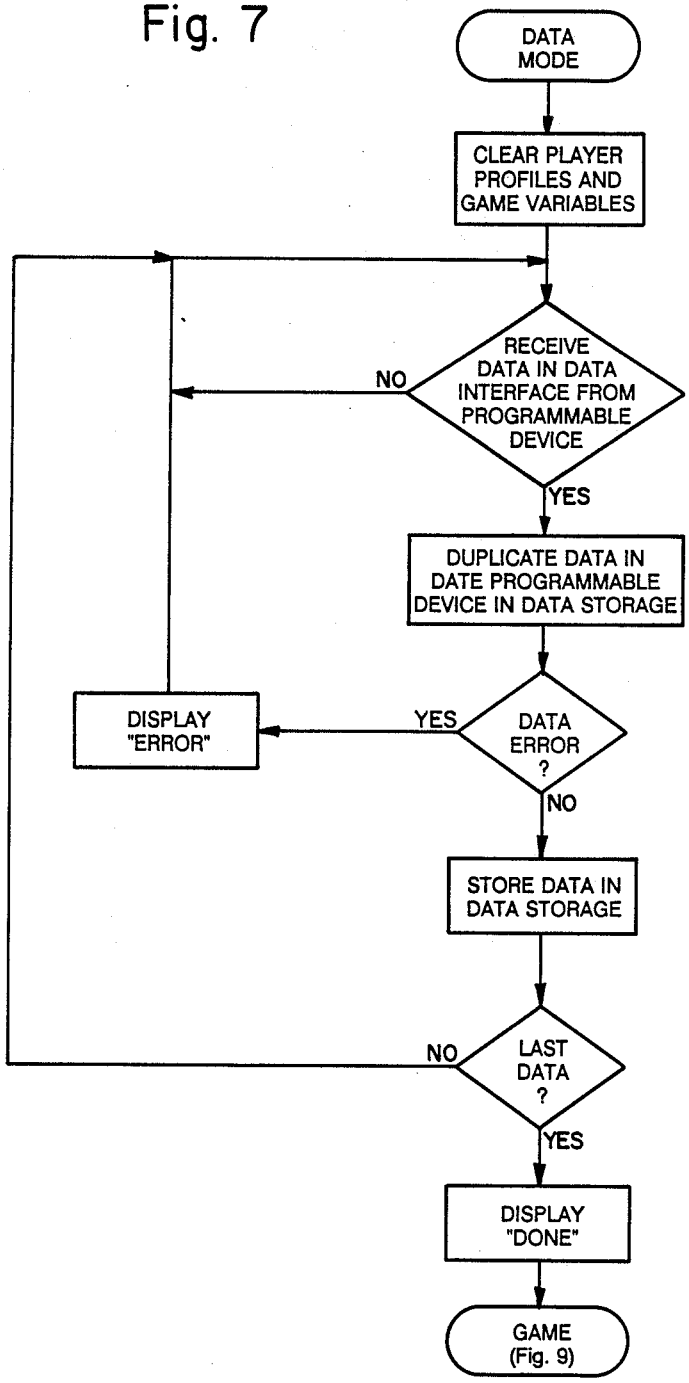
Figure 8:
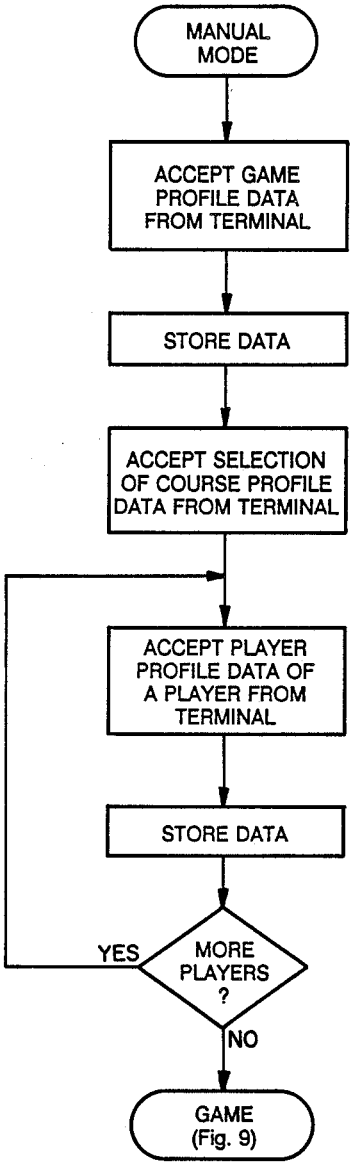
Figure 9:
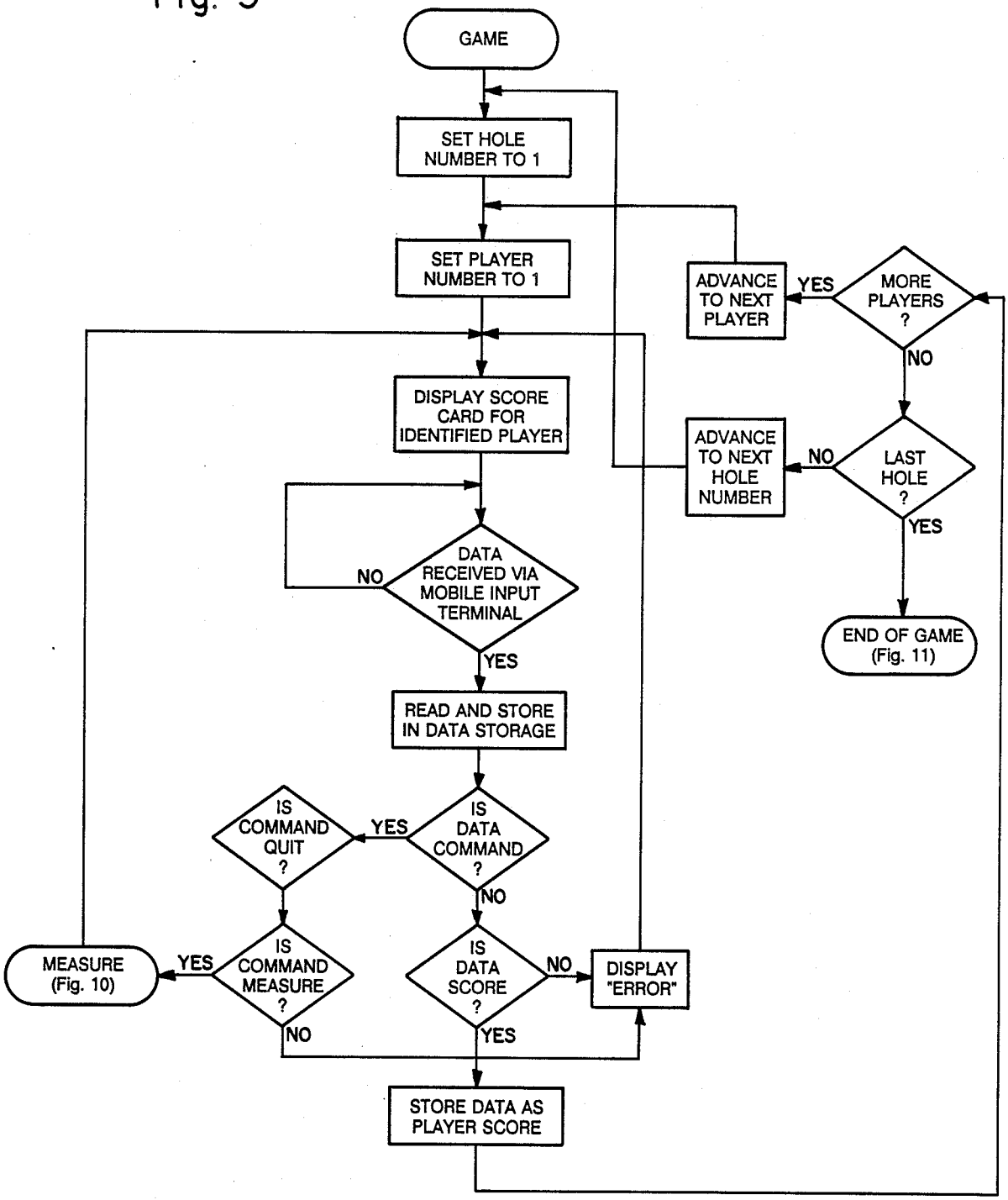
Figure 10:
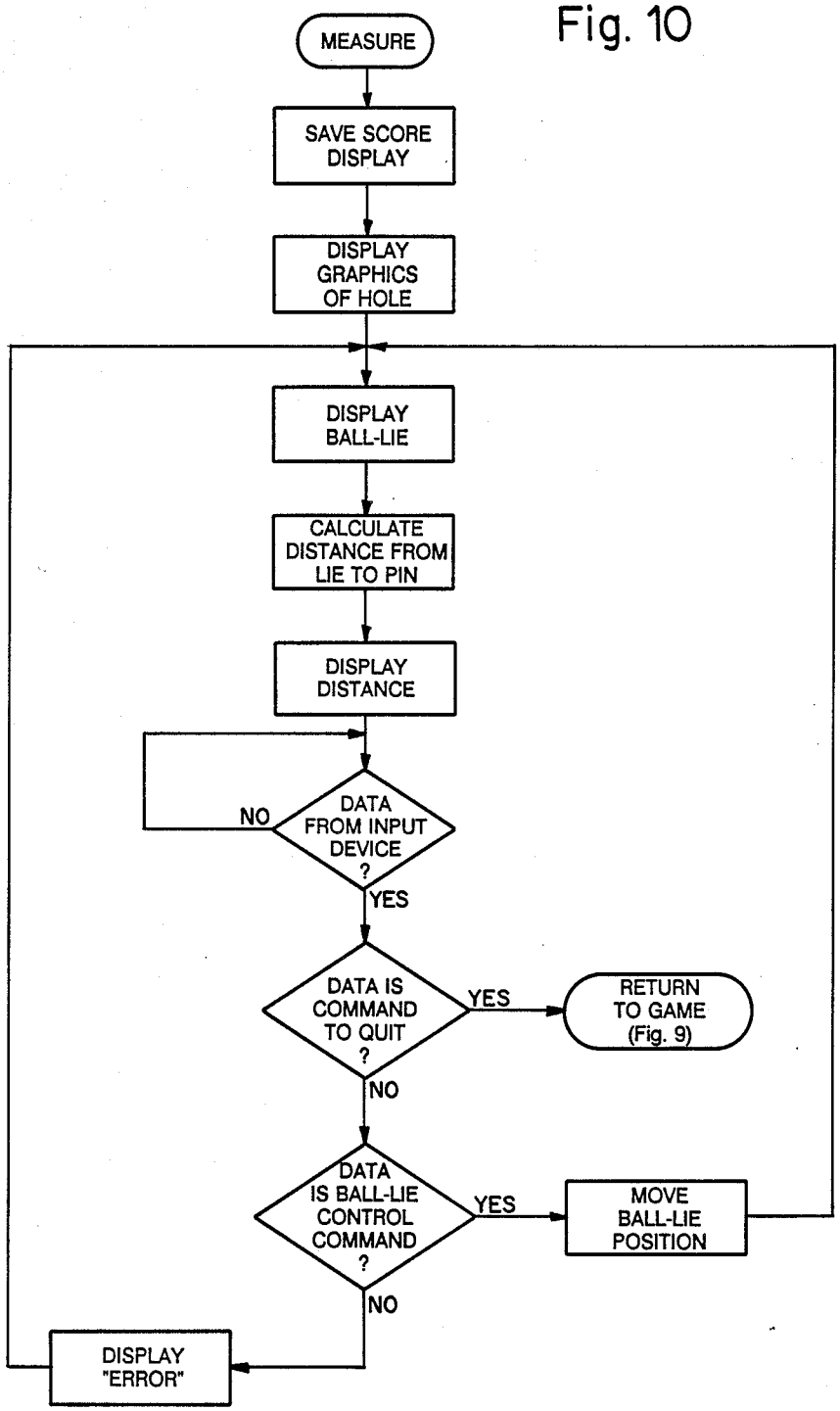
Figure 11:
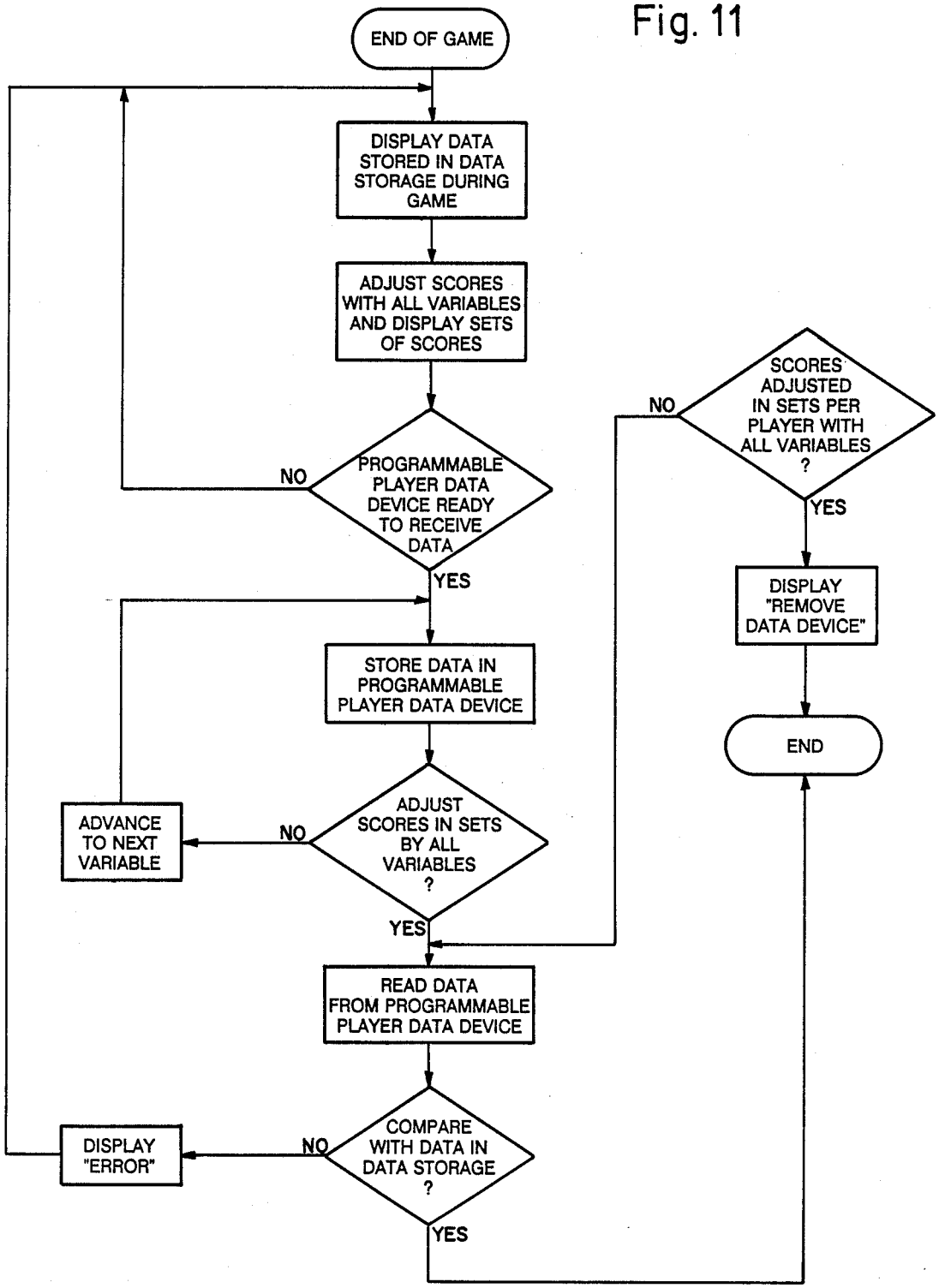

FIG. 5, for example is a basic flow chart for a mobile computer module. It is believed the basic flow chart is self explanatory. The flow charts represented in FIGS. 6, 7 and 8 prepare the mobile module for use by the players on the golf course. FIGS. 9, 10 and 11 are flow charts that relate to the game. FIG. 9 is the basic flow chart of the game while FIG. 10 relates to measurement or scoring and score keep and FIG. 11 relates to the storing of the scoring data in the programmable transferable device or RAM.

It is believed that one skilled in the art can readily understand the example flow charts for the program and cyclic operations of the mobile computer module.

Figure 12:
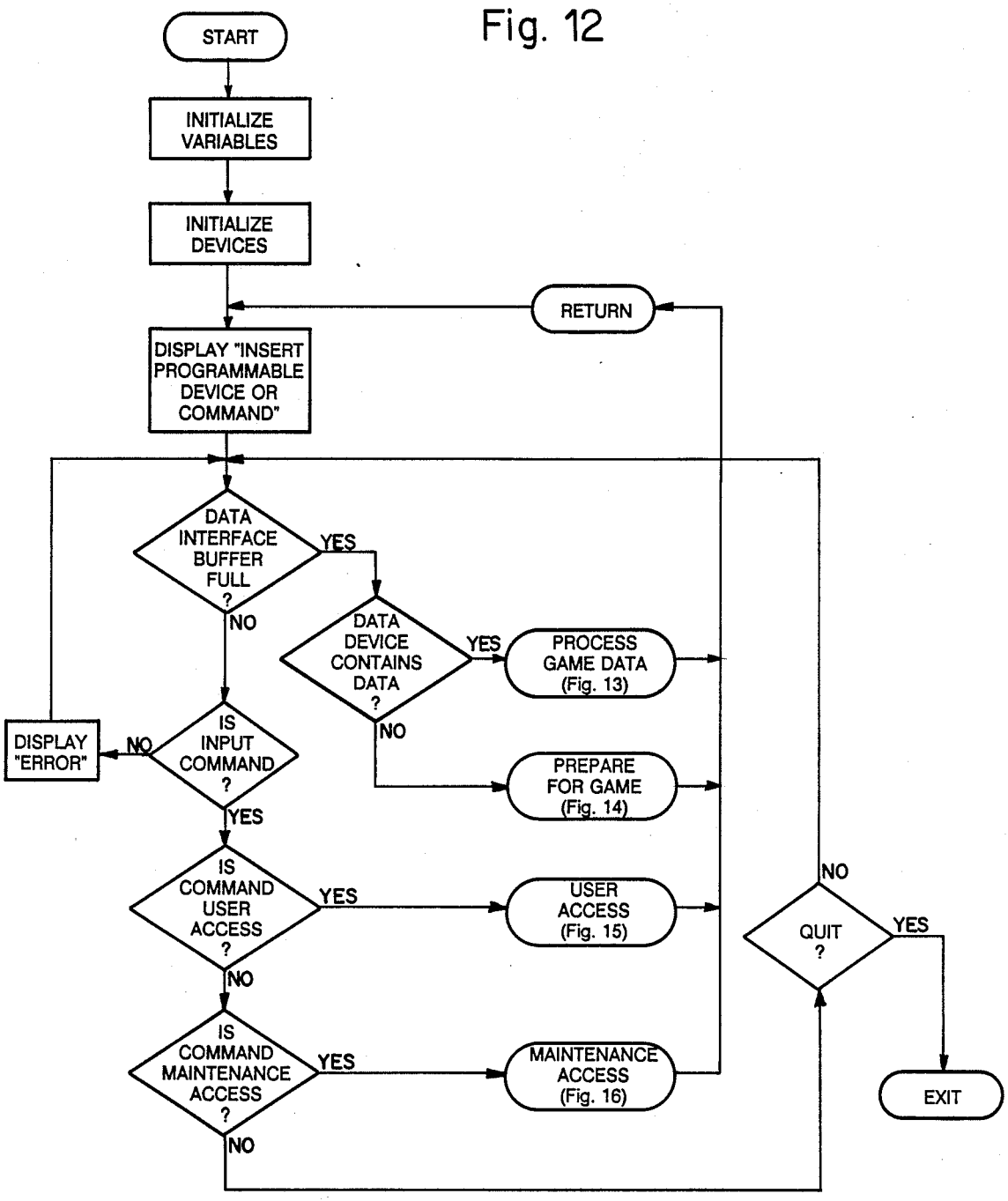
FIG. 12 is a representation of a basic flow chart for the local master computer module usable in a golf score recording system and network.
Figure 13:
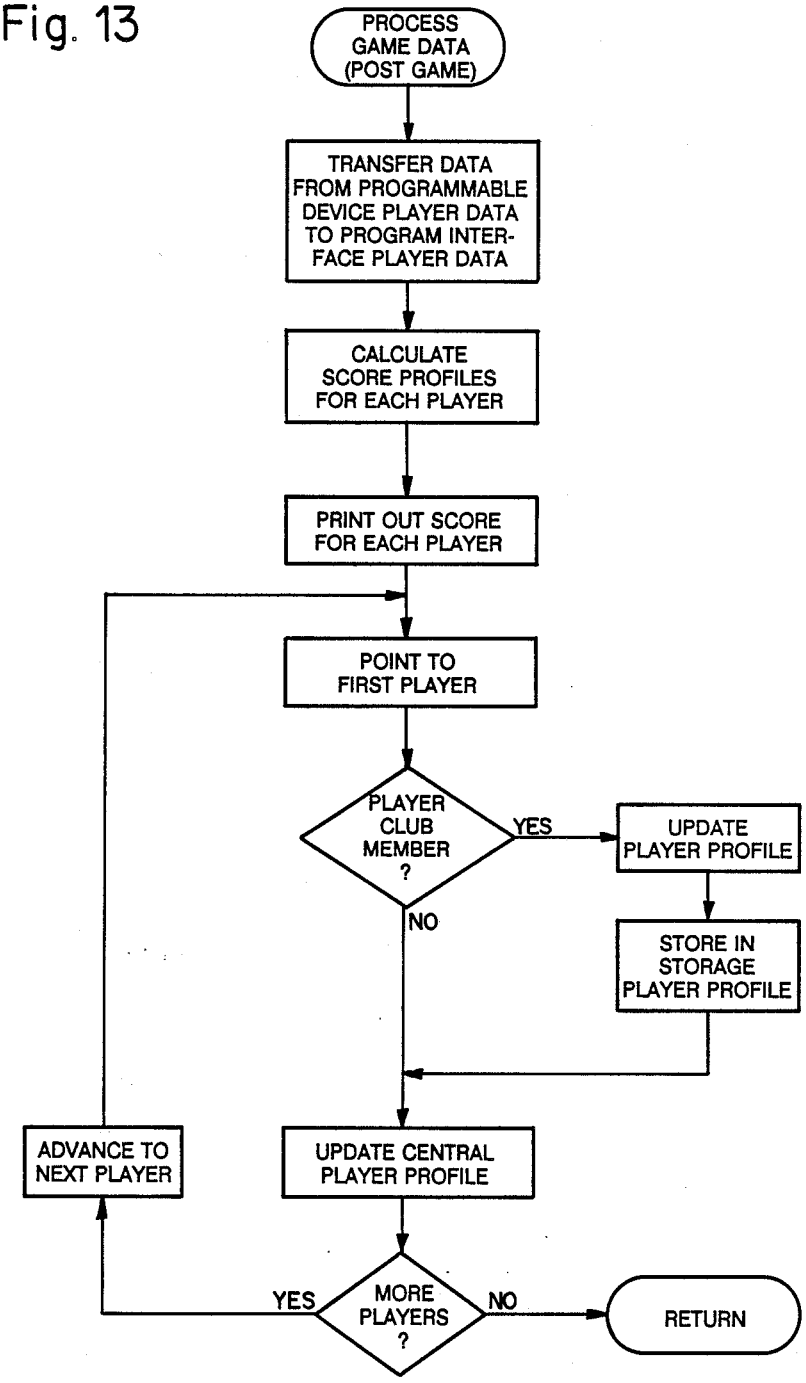
FIG. 13 through 16 inclusive are flow charts of the various processing required in the basic flow chart for the local master module.
Figure 14:
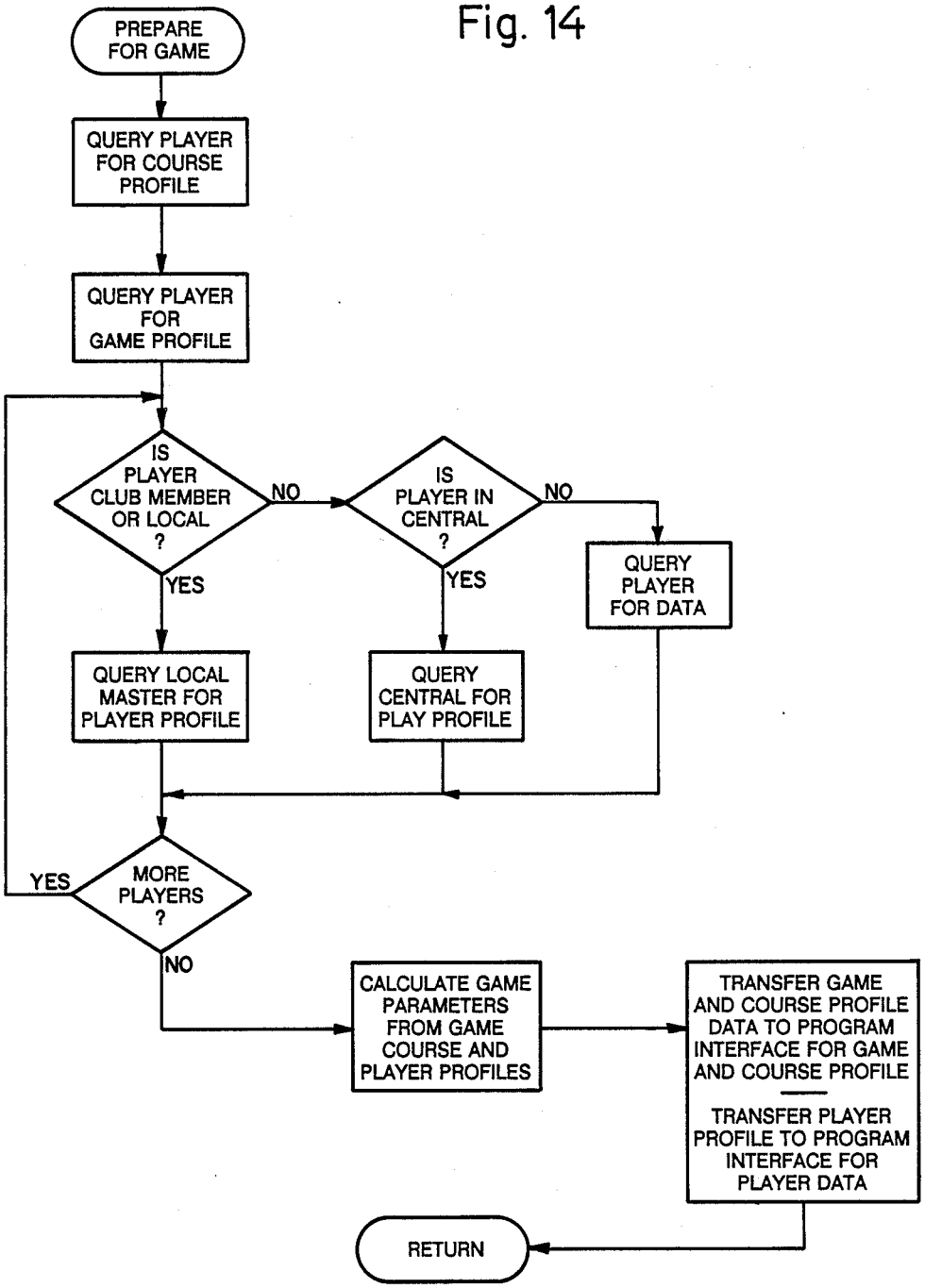
Figure 15:
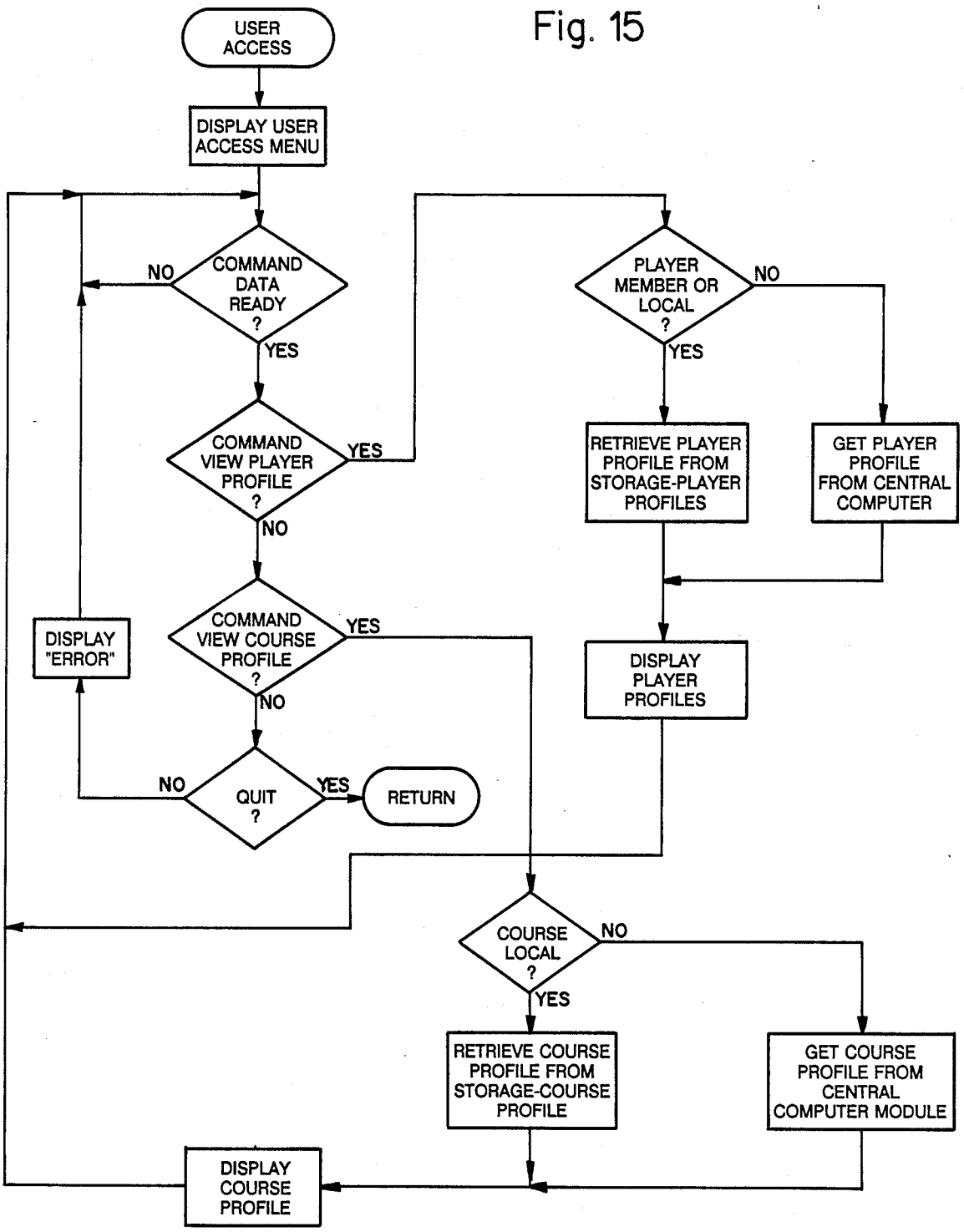
Figure 16:
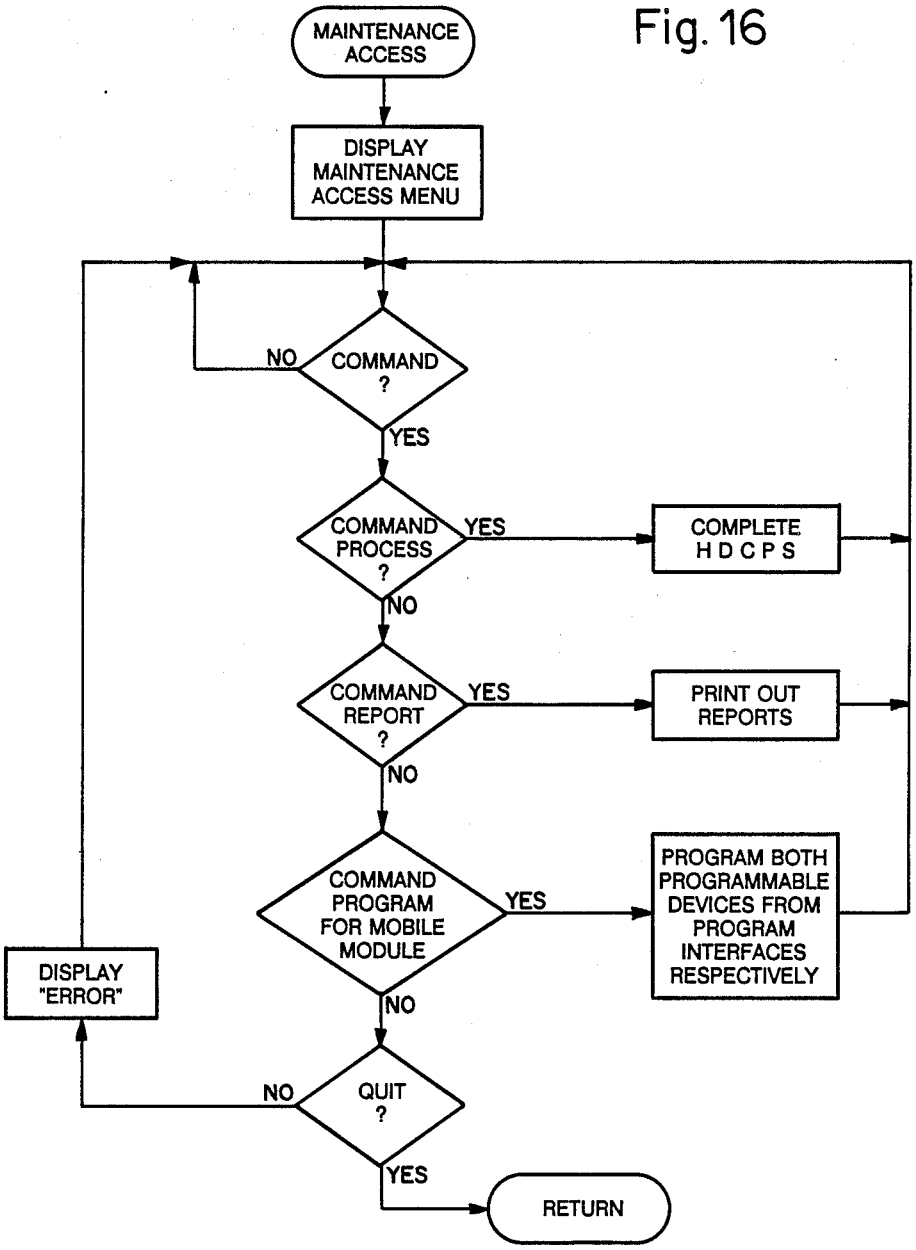

FIG. 12 through 16 inclusive are examples of a set of flow charts that may be used for the local master computer module. FIG. 12 is an example of a basic flow chart while FIG. 13 is an example of a flow chart for post-game operation of the local master module, FIG. 14 is an example of a flow chart for pre-game or preparation for the game operation of the local master module while FIGS. 15 and 16 are flow charts for programming the programmable, transferable devices with player data and course data respectively.

Figure 17A:
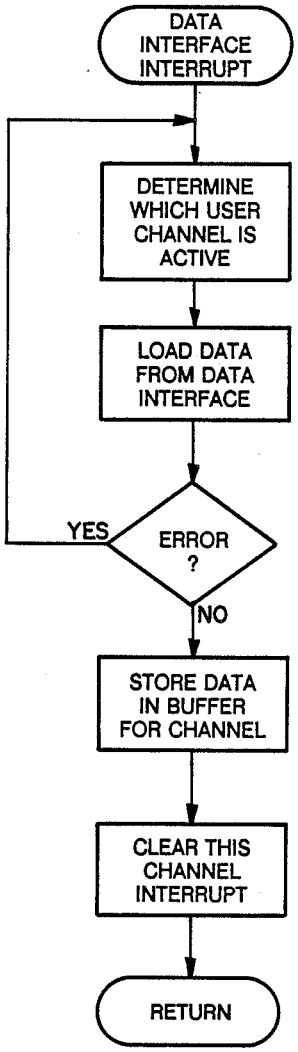
FIG. 17*a* is a flow chart of a data interface interrupt process for the local master module.
Figure 17B:
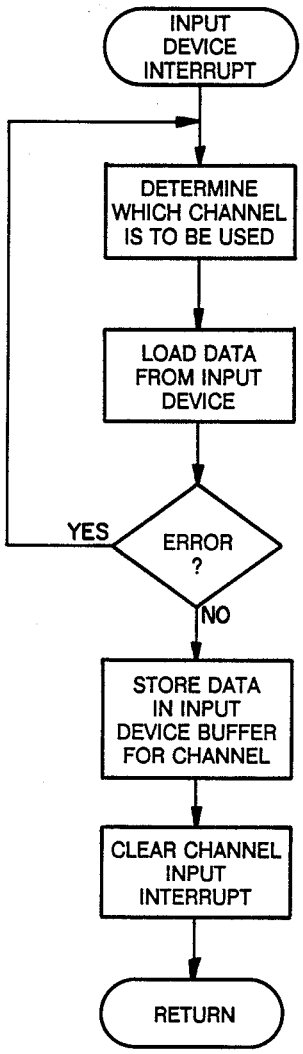
FIG. 17*b* is a flow chart of an input device interrupt process for the local master module.

The flow charts represented in FIGS. 17*a* and 17*b* may be used to control traffic into and out of the local master computer module and also for controlling traffic into and out of the central computer module.

Thus there has been described a network or system, in multi-level structure, for scoring, reporting and storing golf scores of golf players with apparatus used for score keeping assistance to the player and score storage at the golf club level and storage and retrieval of player data and golf course characteristics at a higher level. The apparatus suggested for use in the system are examples of apparatus that may be used. Changes may be made and substitutions may be made as will be apparent to those skilled in the art without departing from the invention.

What is claimed is:

1. A system for generating, a storing and retrieving golf data relating to a plurality of golf players playing golf on a plurality of different courses in said system, said system comprising:

(a) a central computer means for receiving and storing selected golf data from each local master computer means of a plurality of local master computer means and for transmitting all or part of said selected golf data to a local master computer means of said plurality of local master computer means upon request from said local master computer means;

(b) each local master computer means of said plurality of local master computer means being associated with a golf club and each local master computer means identified with a different golf course respectively, each said local master computer means including, (i) a first interface for receiving a first transferable memory and (ii) a first data storage means for receiving from said first transferable memory, golf data relating to golf players who play on the golf course with which the respective local master computer means is identified and for storing said golf data in said first data storage means, said local master computer means for programming said first transferable memory with at least a portion of said selected golf data, and said local master computer means for transmitting data stored in said first data storage means to said central computer means; and (c) a plurality of groups of mobile computer means, each group of mobile computer means of said plurality of groups being associated with a particular local master computer means and each mobile computer means of the same group of mobile computer means for use by golf players while playing golf on the golf course identified with the said particular local master computer means, each said mobile computer means including, (i) a second interface for receiving said first transferable memory, said first transferable memory having been programmed with said at least a portion of said selected golf data relating to the golf players intending to use the particular mobile computer means and, (ii) data input means for receiving a golf scoring data from the golf players using the mobile computer means, said data input means also for storing said golf scoring data in said mobile computer means, said mobile computer means for adjusting golf data relating to said golf players and for storing an adjusted golf data in said first transferable memory said first interface of receiving said first transferable memory and said first data storage means for receiving and storing said at least a portion of said selected golf data and said golf scoring data and said adjusted golf data in the local master computer means with which the mobile computer means is associated.

2. A system for generating, storing and retrieving golf data as in claim 1 and in which each local master computer means further includes third interface means for receiving a transferable memory and a second data storage means for storing a course profile of the golf course with which a particular local master computer means is identified, said second data storage means for programming said second transferable memory with said course profile.

3. A system as in claim 2 and in which each mobile computer means includes a fourth interface means for receiving said second transferable memory and said mobile computer means further includes a display means for providing a visual display of the golf course identified with the local master computer means with which a particular mobile computer means is associated.

4. A network of apparatus for generating, receiving, storing and programming golf data related to golf players playing golf on selected golf course, said network including:

(a) a central data receiving, data storing and data transmittal means for receiving fold data from each of a plurality of local clubhouse golf data receiving, storing and transmitting means, and for storing said golf data and for transmitting to a local clubhouse golf data receiving, storing and transmitting means of said plurality all or part of said golf data upon request;

(b) each said local clubhouse golf data receiving, storing and transmitting means of said plurality of local clubhouse golf data receiving, storing and transmitting means coupled to said central means for communicating therewith and each said local clubhouse means associated with a golf club, of a plurality of golf clubs and each said local clubhouse means identified with a different golf course respectively; and (c) a plurality of platoons of mobile means each platoon of mobile means of said plurality of platoons associated with a particular local clubhouse means respectively and each mobile means of a same platoon of mobile means for use on the golf course identified with the local clubhouse means with which said same platoon of mobile means is associated.

5. A network of apparatus as in claim 4 and in which said local clubhouse means includes a memory means programmed with a course profile of the golf course with which a particular local clubhouse means is identified.

6. A network of apparatus for generating receiving, storing and programming golf data related to golf players playing golf on selected golf courses, said network including;

(a) a central data receiving, data storing and data transmittal means for receiving golf data from a lower level medium and for storing said golf data and for transmitting to said lower level medium all or part of said golf data upon request from said lower level medium;

(b) said lower level medium including a plurality of local data receiving, data storage, data transmittal and data programming means each local means of said plurality of local means coupled to said central means for communicating therewith, and, each said local means associated with a golf club and each said local means identified with a different golf course respectively;

(c) a plurality of platoons of mobile means each platoon of mobile means of said plurality of platoons associated with a particular local means respectively and each mobile means of a same platoon for use on the golf course identified with the local means with which the said platoon is associated;

(d) each said local means including a first memory means programmed with a course profile of a golf course with which a particular local means is identified; and, (e) each said local means further includes a first interface adapted to receive a first transferable programmable means and said first memory means includes means for programming said course profile into said first transferable programmable means when said first transferable programmable means is in said first interface.

7. A network of apparatus as in claim 6 and in which said mobile means includes a second interface adapted to receive said first transferable, programmable means and said mobile means further includes means for graphically displaying said course profile visually.

8. A network of apparatus as in claim 7 and in which said local means further includes third interface means adapted for receiving a second transferable, programmable means and said local means also includes a second memory means for storing player profiles of players who play golf on a golf course with which a particular local means is identified.

9. A network of apparatus as in claim 8 and in which said local means also includes means for duplicating said player profiles stored in said second memory means in said second transferable, programmable means when said second transferable programmable means is in said third interface means.

10. A network of apparatus as in claim 9 and in which said mobile means further includes a fourth interface means for receiving said second transferable, programmable means and also includes a programmable means for duplicating said player profiles previously programmed in said second transferable, programmable means, in said programmable means when said second transferable, programmable means is in said fourth interface of said mobile means.

11. A network of apparatus as in claim 10 and in which said mobile means further includes means for inputting golf stroke scores into said programmable means of said mobile means and for duplicating data programmed into said programmable means into said second transferable, programmable means when said second transferable, programmable means is in said fourth interface.

12. A network of apparatus as in claim 11 and in which said local means includes means for storing in said second memory means the data duplicated into said second transferable, programmable means by said mobile means when said second transferable, programmable means is in said third interface of said local means.

13. A system for generating, storing and retrieving golf data relating to a plurality of golf players playing golf on a plurality of different golf courses in said system, said system comprising:

(a) a central computer means for receiving and storing selected golf data from each local master computer means of a plurality of local master computer means and for transmitting all or part of said selected golf data to a local master computer means of said plurality of local master computer means upon request from said local master computer means;

(b) each local master computer means of said plurality of local master computer means being associated with a golf club and each local master computer means identified with a different golf course respectively, each said local master computer means including, (i) a first interface for receiving a first transferable memory and, (ii) a data storage means for receiving from said first transferable memory, golf data relating to golf players who play on the golf course with which the respective local master computer means is identified and for storing said golf data in said data storage means, said local master computer means for programming said first transferable memory with at least a portion of said selected golf data, and said local master computer means for transmitting data stored in said data storage means to said central computer means; and (c) a plurality of groups of mobile computer means each group of mobile computer means of said plurality of groups being associated with a particular local master computer means and each mobile computer means of the same group of mobile computer means for use by golf players while playing golf on the gold course identified with the said particular local master computer means, each said mobile computer means including, (i) a second interface for receiving said first transferable memory, said first transferable memory having been programmed with said at least a portion of said selected golf data relating to the golf players intending to use the particular mobile computer means and, (ii) data input means for receiving a golf scoring data from the golf players using the mobile computer means, said data input means also for storing said golf scoring data in said mobile computer means, said mobile computer means for adjusting golf data relating to said golf player and for storing an adjusted golf data in said first transferable memory, said first interface for receiving said first transferable memory and said data storage means for receiving and storing said at least a portion of said selected golf data and said golf scoring data and said adjusted golf data in the local master computer means with which the mobile computer means is associated.

14. A system for generating, storing and retrieving golf on a plurality of different golf course in playing golf on a plurlaity of different golf courses in said system, said system comprising:

(a) a central computer means for receiving and storing selected golf data from each local master computer means of a plurality of local master computer means and for transferring all of said selected golf data to a local master computer means of said plurality of local computer means upon request from said local master computer means;

(b) each local master computer means of said plurality of local master computer means being associated with a golf club and each local master computer means identified with a different golf course respectively, and said local master computer means including, (i) a first interface for receiving a transferable memory, and (ii) a data storage means for receiving from said transferable memory golf data relating to golf players who play on the golf course with which the respective local master computer means is identified and for storing said gold data in said data storage means, said local master computer means for programming said transferable memory with at least a portion of said selected golf data, and said local master computer means for transmitting data stored in said data storage means to said central computer means;

(c) a plurality of groups of mobile computer means, each group of mobile computer means of said plurality of groups being associated with a particular local master computer means and each mobile computer means of the same group of mobile computer means for use by golf players while playing golf on the golf course identified with the said particular local master computer means, each said mobile computer means including, (i) a second interface for receiving said transferable memory, said transferable memory having been programmed with at least a portion of said selected golf data relating to the golf players intending to use the particular mobile computer means and, (ii) data input means for receiving a golf scoring data from the group player using the mobile computer means, said data input means also for storing said golf scoring data in said mobile computer means, said mobile computer means for adjusting golf data relating to said golf player and for storing an adjusted golf data in said transferable memory, said first interface for receiving said transferable memory and said data storage means for receiving and storing said at least a portion of said selected golf data and said golf scoring data and said adjusted golf data in the local master computer means with which the mobile computer means is associated;

(d) said central computer means being one of a plurality of central computer means, each central computer means for receiving and storing selected golf data from different plurality of local master computer means, and (e) a higher level central computer means for receiving and storing selected golf data from each of the plurality of lower level central computer means.

* * * * *